United States Patent [19]

Hori et al.

[11] 4,385,599

[45] May 31, 1983

[54] SELF-CONTAINED HYDRAULIC LASH ADJUSTER

[75] Inventors: Takanobu Hori, Toyota; Fumio Arai, Kariya; Hisashi Kodama, Nagoya, all of Japan

[73] Assignee: Aisin Seiki Kabushiki Kaisha, Kariya, Japan

[21] Appl. No.: 213,518

[22] Filed: Dec. 5, 1980

[30] Foreign Application Priority Data

Dec. 17, 1979 [JP] Japan ..... 54-175134[U]

[51] Int. Cl.[3] ..... F01L 1/24

[52] U.S. Cl. ..... 123/90.58

[58] Field of Search ..... 123/90.55, 90.58

[56] References Cited

U.S. PATENT DOCUMENTS 2,956,557 10/1960 Dadd ..... 123/90.55

4,191,141 3/1980 Kodama ..... 123/90.58

FOREIGN PATENT DOCUMENTS 2911550 9/1979 Fed. Rep. of Germany ... 123/90.55

614007 12/1948 United Kingdom ..... 123/90.58

*Primary Examiner*—Craig R. Feinberg

*Assistant Examiner*—W. R. Wolfe

*Attorney, Agent, or Firm*—Sughrue, Mion, Zinn, Macpeak and Seas

[57] ABSTRACT

A self-contained hydraulic lash adjuster in which a sealing member is provided on the plunger for providing fluid tight seal between the plunger and a cylinder member. The sealing member is of a pair of lips both of which are in fluid tight contact with the cylinder member and are alternately deformed onto the cylinder member upon upward or downward movement of the plunger. During movement of the plunger, fluid-tight seal between the plunger and the cylinder member is assured with a little sliding friction therebetween.

1 Claim, 4 Drawing Figures

SELF-CONTAINED HYDRAULIC LASH ADJUSTER

BACKGROUND OF THE INVENTION

1. Field of the Invention

This invention relates to a hydraulic lash adjuster used in a valve train of an internal combustion engine, and more particularly to a hydraulic lash adjuster of the self-contained type in which the fluid is sealed within the assembly without provision for its replenishment from any external source during operation.

2. Description of the Prior Art

In the hydraulic lash adjuster of this type, there is provided an O-ring in an annular groove on a plunger which is slidably mounted in a cylinder member so as to prevent entrance of engine oil into a operating fluid. However, the sliding friction between the O-ring and the cylinder member is relatively so large that the plunger cannot be moved smoothly. Consequently, the reciprocal movement of the plunger is out of accord with an engine operation with resulting that tapet noise is generated due to malfunction of the lash adjuster.

SUMMARY OF THE INVENTION

It is, therefore, one of the objects of this invention to provide a self-contained hydraulic lash adjuster without aforementioned drawbacks.

It is another object of this invention to provide a hydraulic lash adjuster in which a sealing member is provided between a plunger and a cylinder member with a little sliding friction therebetween.

It is a further object of this invention to provide a hydraulic lash adjuster in which a pair of lips of a sealing member are alternatively deformed onto a cylinder member with a little sliding friction therebetween upon upward or downward movement of a plunger.

BRIEF DESCRIPTION OF THE DRAWINGS

These and other objects of this invention will be apparent from the following description of a preferred embodiment, having reference to the drawings wherein.

DESCRIPTION OF THE PREFERRED EMBODIMENT

Figure 1:
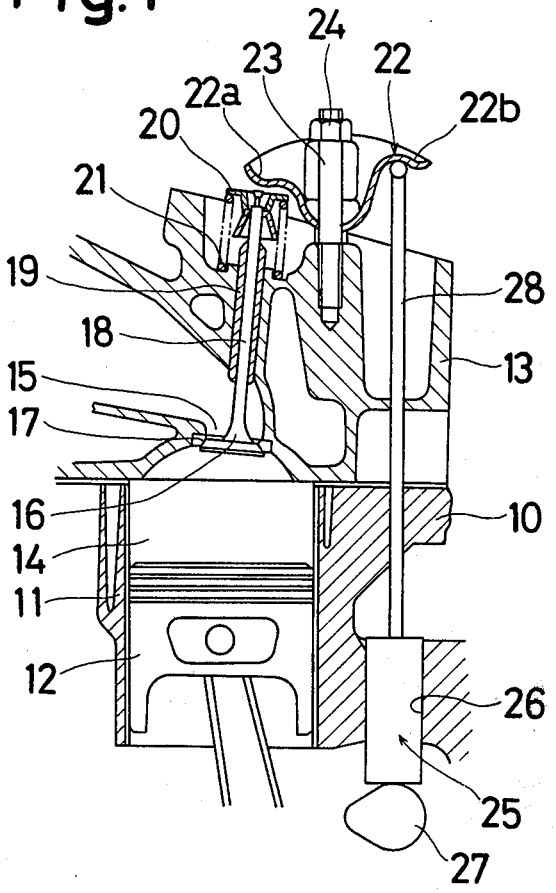
FIG. 1 is a transverse sectional view through a portion of an internal combustion engine having valve operating train incorporating a hydraulic lash adjuster constituted in accordance with this invention.

Referring now in detail to the drawings, there is illustrated in FIG. 1 an engine cylinder block 10 having a cylinder bore 11 in which a piston 12 is reciprocably mounted. At the top of the cylinder block 10, there is suitably secured a cylinder head 13 and a combustion chamber 14 is formed between the piston 12 and the cylinder head 13. Communication between the combustion chamber 14 and a head port 15 is controlled by a poppet valve 16 co-operating with a seat 17 thereof in the closed position. The valve 16 has a stem 18 slidably mounted in a guide member 19 which is driven into the cylinder head 13. The stem 18 is provided with a retainer 20 at an upper end portion thereof. A spring 21 is stretched between the retainer 20 and the cylinder head 13 so that the stem 18 may be biased in the upward direction. Thus, an upper end of the stem 18 is brought into abutment with one end portion **22*a* of a rocker arm 22. The rocker arm 22 is rockably mounted on the cylinder head 13 by a stud 23 and a nut 24**.

A hydraulic lash adjuster 25 according to the present invention is slidably mounted in an adjuster bore 26 in the cylinder block 10, and is reciprocably moved in accordance with rotation of a cam 27. The cam 27 is operatively connected to the piston 12 via crank-shaft (not shown). Between the other end portion **22*b* of the rocker arm 22 and an upper portion of the lash adjuster 25, there is interposed a rod 28 so that the vertical movement of the lash adjuster 25 may be transmitted to the rocker arm 22. Thus, the valve 16 is brought into operation thereof in accordance with reciprocal movement of the piston 12**.

Figure 2:
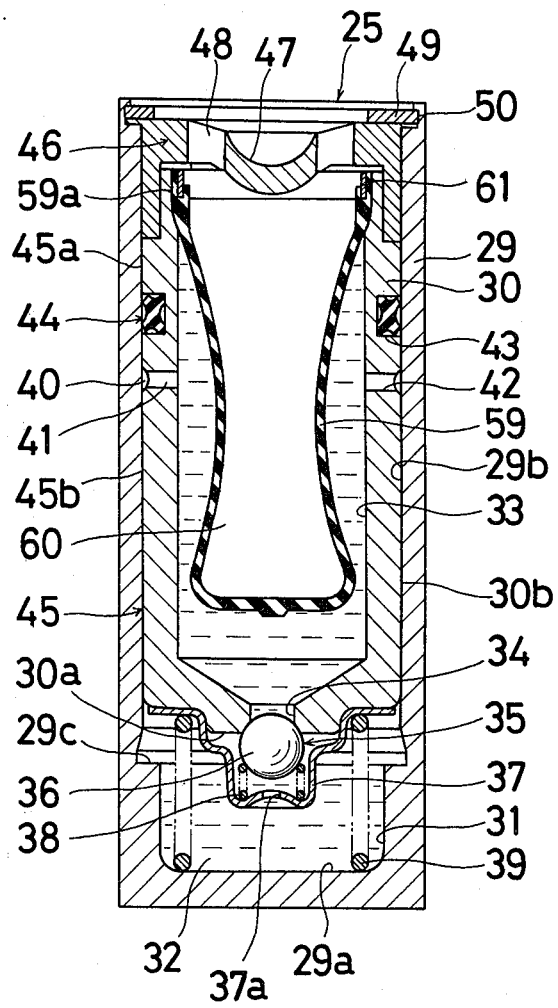
FIG. 2 is an enlarged longitudinal sectional view through the lash adjuster of FIG. 1, showing its internal construction in detail.

As shown in FIG. 2, the lash adjuster 25 comprises a cylinder member 29 and a plunger 30 slidably mounted therein. Between a closed end portion **29*a* and a bottom portion 30*a*, there is defined a fluid pressure chamber 31 which is filled with operating fluid 32 such as lubricating oil. The plunger 30 is formed to constitute an axially hollow reservoir chamber 33 and a passage 34 continued therefrom. The passage 34 is communicable with the pressure chamber 31 via check valve 35 which is in the form of a ball 36. Between the ball 36 and a cup-shaped cage 37, there is stretched a spring 38 so that the passage 34 may be closed by the ball 36. The check valve 35 is so designed that upon release thereof operating fluid 32 may flow into the pressure chamber 31 with a relatively rapid rate from the reservoir chamber 33, but not in the reverse direction. The cage 37 is provided at central portion thereof with an aperture 37*a*, and are pressed onto the bottom portion 30*a* of the plunger 30 by a spring 39. The load of the spring 39 is larger than that of the spring 38**.

On an outer surface **30*b* of the plunger 30 is provided an annular semi-circular groove 40. The groove 40 is in communication with the reservoir chamber 33 via radial holes 41 and 42. Above the semi-circular groove 40, there is provided an annular rectangular groove 43 in which a sealing member 44 (detail will be described later) is fitted. Between an inner surface 29*b* of the cylinder body 29 and the outer surface 30*b* of the plunger 30, there is formed a slight clearance 45 which is divided into an upper clearance 45*a* and a lower clearance 45*b* by the sealing member 44. Through the lower clearance 45*b*, a leakage of operating fluid 32 from the pressure chamber 31 will be conducted with relatively slow rate during each lift stroke of the cam 27 while the check valve 35 is closed. The leakage trickles into the semi-circular groove 40 and enters the reservoir chamber 33 through the holes 41 and 42. Thus, operating fluid exists in the lower clearance 45*b*, while engine oil exists in the upper clearance 45*a***.

An open upper end portion of the plunger 30 is closed by a seat member 46 having a concave portion 47 for receiving a convex lower end (not shown) of the rod 28 and a plurality of holes 48 around the concave portion 47. Thus, thrust of the plunger 30 is transmitted to the rod 28 through the seat member 46. The vertical movement of the plunger 30 is limited by a snap ring 49 fitted in an groove 50 and a stepped portion **29*c* on the inner surface 29*b* of the cylinder member 29**.

Figure 3:
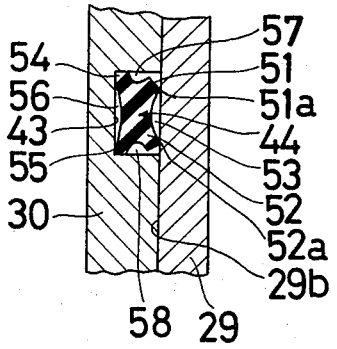
FIG. 3 is an enlarged sectional view of a sealing member and there around.

In FIG. 3, there is illustrated an enlarged cross-sectional view of the sealing member 44. An outer surface of the sealing member 44 is of a pair of lips 51 and 52 between which is formed a groove 53. Both of the lips 51 and 52 are provided with sharp edged portions 51*a* and 52*a* respectively both of which are in contact with the inner surface 29*b* of the cylinder member 29. An inner surface of the sealing member 44 is of a pair of lips 54 and 55 between which is formed a groove 56. The distance between the lips 54 and 55 is larger than the width of the rectangular groove 43 for sure and easy fixation of the sealing member 44 therein. Above and below the sealing member 44, there are respectively formed an upper space 57 and a lower space 58. The lip 51 is so designed that it may be deformed in the clockwise direction due to engine oil collected in the upper space 57 upon the upward movement of the plunger 30. Thus, the edged portion 51*a* of the sealing member 44 is brought into fluid-tight contact with the inner surface 29*b* of the cylinder member 29 with little sliding friction, thereby preventing entrance of engine oil into the pressure chamber 31 through the groove 53, the lower space 58, and the lower clearance 30*b*. Similarly, the lip 52 is so designed that it may be deformed in the counter-clockwise direction due to operating fluid collected in the lower space 58 upon downward movement of the plunger 30. Thus, the edged portion 52*a* of the sealing member 44 is brought into fluid-tight contact with the inner surface 29*b* of the cylinder member 29 with little sliding friction, thereby preventing entrance of engine oil into the pressure chamber 31.

Figure 4:
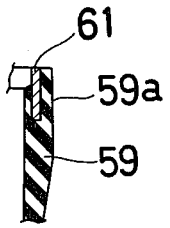
FIG. 4 is an enlarged sectional view of a portion of an open upper end portion of a bag member.

Within the upper portion of the reservoir chamber 33 is provided an elastic synthetic rubber bag member 59 which is of tubular and bottom-closed shape in a disassembled condition. An interior 60 of the bag member 59 is normally in communication with atmospheric pressure through the holes 48. An outer surface of the bag member 59 is in contact with the operating fluid 32. Thus, the volume of the interior 60 of the bag member 59 is variable in response to variation in fluid volume in the reservoir chamber 33. The is to say, the bag member 59 is easily deformable in accordance with fluid volume variation. In order to assure fluid-tight cotact between an upper portion of the bag member 59 and the inner surface 29*b* of the cylinder member 29, there are utilized a thick portion 59*a* of the bag member 59 and a metal ring ring 61, both of which are of elasticity in radially outward direction. Further, as seen from FIG. 4, the metal ring 61 is fixedly disposed in the thick portion 59*a* of the bag member 59 so as to prevent separation of the metal ring 61 from the thick portion 59*a* due to the successive deformations of the bag member 59. The setting of the metal ring 61 is performed simultaneously with forming of the bag member 59.

In operation, each lifting movement of the cylinder member 29 in response to rotation of the cam 27 is transmitted to the plunger 30 through the medium of the hydraulic fluid which is trapped within the pressure chamber 31. The upward movement of the plunger 30 is transmitted to the push rod 28 through the seat 46. As a result, the rocker arm 22 rocks and opens the valve 16 against the spring 21. The spring 21 serves both to maintain the valve 16 normally in the closed position thereof and to return the lash adjuster 26 to the initial position thereof after each lift stroke of the cam 27. Accordingly, since the load of the spring 21 increases and the fluid pressure in the pressure chamber 31 increases, the check valve ball 36 moves to the seated position thereof at lower end of the passage 34. At this time, a slight leakage of fluid from the pressure chamber 31 enters the reservoir chamber 33 through the lower clearance 45*b*, semi-circular groove 40 and the holes 41 and 42, and the plunger 30 is lowered in the cylinder member 29, thereby shortening the axial length between the seat 46 and the closed end portion 29*a* of the cylinder member 29. During movement of the plunger 30 in the downward direction, the lip 52 of the sealing member 44 is deformed to rotate in the counter-clockwise direction and is pressure onto the inner surface 29*b* of the cylinder member 29 due to operating fluid collected in the lower space 58. Thus, the fluid-tight seal between the plunger 30 and the cylinder member 29 is assured with little sliding friction.

When the cam 27 is lowered after completion of each lift stroke thereof, the cylinder member 29 is moved downwardly. As a result, the load of the spring 21 decreases and the valve 16 is brought to close. Since the volume of the pressure chamber 33 is increased by the action of the spring 39, the fluid pressure in the pressure chamber 33 is decreased. This pressure decrease in the pressure chamber 31 permits the check valve 35 to open. Then the sufficient fluid flows to the pressure chamber 31 through the passage 34 to compensate for leakage through the lower clearance 45*b*, thereby returning the axial length between the seat 46 and the closed end portion 29*a* of the cylinder member 29 to the initial length. During upward movement of the plunger 30, the lip 51 of the sealing member 44 is deformed to rotate in the clock-wise direction and is pressed onto the inner surface 29*b* of the cylinder member 29 due to engine oil collected in the upper space 57. Thus, the fluid-tight seal between the plunger 30 and the cylinder member 29 is assured with little sliding friction therebetween.

During vertical movement of the plunger 30, the bag 59 is deformed flexibly in response to volume variation in operating fluid. In spite of deformation of the bag 59, the metal ring 61 may not be separated from the thicked portion 59*a* of the bag 59, because the ring 61 is fixedly mounted in the thicked portion 59*a*.

What is claimed is:

1. A self-contained hydraulic lash adjuster comprising a cylinder member having a closed end portion, a plunger slidingly mounted in said cylinder member, a reservoir chamber located in said plunger, a pressure chamber defined between said plunger and said closed end portion of said cylinder member, a check valve for allowing fluid flow only from said reservoir chamber to said pressure chamber through a passage in said plunger, a return spring stretched between said plunger and said closed end portion of said cylinder member for urging said plunger in the upward direction, a leakage clearance formed between an inner surface and an outer surface of said plunger, a first annular groove provided on said outer surface of said plunger, radial hole means extended through said plunger in communication with said first annular groove to connect said leakage clearance to said reservoir chamber, a second annular groove provided on said outer surface of said plunger above said first annular groove, a sealing member fitted in said second groove for providing fluid-tight seal between said plunger and said cylinder member, and having a pair of lips with sharp edged portions in contact with said outer surface of said cylinder member and being alternately deformed onto said outer surface of said cylinder member upon upward or downward movement of said plunger, a seat member for closing an open upper end portion of said plunger and for transmitting the thrust of a push rod to said plunger, and an elastomeric bag member having a generally tubular shape with a closed bottom end and an open upper portions, said open upper end being fixed to an upper end portion of said reservoir chamber, an interior of said bag member being normally disposed in communication with atmospheric pressure through hole means in said seat member and an outer surface of said bag member in fluid-tight contact with operating fluid in said reservoir chamber.

* * * * *